US009399913B2

(12) United States Patent
Murphy et al.

(10) Patent No.: US 9,399,913 B2
(45) Date of Patent: Jul. 26, 2016

(54) PUMP CONTROL FOR AUXILIARY FLUID MOVEMENT

(71) Applicant: Schlumberger Technology Corporation, Sugar Land, TX (US)

(72) Inventors: Jeremy Murphy, Sugar Land, TX (US); Sylvain Ramshaw, Sugar Land, TX (US); Satya Bhan, Houston, TX (US); Julian J. Pop, Houston, TX (US); Steven Villareal, Houston, TX (US); Kent D. Harms, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 264 days.

(21) Appl. No.: 13/937,524

(22) Filed: Jul. 9, 2013

(65) Prior Publication Data

US 2015/0013973 A1 Jan. 15, 2015

(51) Int. Cl.
*E21B 49/10* (2006.01)
*E21B 49/08* (2006.01)

(52) U.S. Cl.
CPC ..... *E21B 49/10* (2013.01); *E21B 2049/085* (2013.01)

(58) Field of Classification Search
CPC ..... E21B 49/10; E21B 49/081; E21B 49/08; E21B 2049/085; E21B 49/082; E21B 49/008; E21B 49/087
See application file for complete search history.

(56) References Cited

U.S. PATENT DOCUMENTS

| | | | | |
|---|---|---|---|---|
| 5,195,588 | A | 3/1993 | Dave | |
| 5,473,939 | A * | 12/1995 | Leder | E21B 23/06 166/264 |
| 5,692,565 | A | 12/1997 | MacDougall et al. | |
| 5,799,733 | A | 9/1998 | Ringgenberg et al. | |
| 5,803,186 | A | 9/1998 | Berger et al. | |
| 6,047,239 | A | 4/2000 | Berger et al. | |
| 6,446,720 | B1 | 9/2002 | Ringgenberg et al. | |
| 6,467,544 | B1 | 10/2002 | Brown et al. | |
| 6,478,096 | B1 | 11/2002 | Jones et al. | |
| 6,543,544 | B2 | 4/2003 | Schultz et al. | |
| 6,568,487 | B2 | 5/2003 | Meister et al. | |

(Continued)

OTHER PUBLICATIONS

Burgess et al., "Wireline-Conveyed Through-Casing Formation Tester Preserves Casing Integrity" (SPE 72371), paper for presentation at SPE Eastern Regional Meeting in Canton, Ohio, Oct. 17-19, 2001.

(Continued)

*Primary Examiner* — Zakiya W Bates
(74) *Attorney, Agent, or Firm* — Kenneth L. Kincaid

(57) ABSTRACT

A method includes drawing formation fluid from a formation into a pressure test chamber of a downhole tool while the downhole tool is positioned at a location within a wellbore. The method also includes, while the downhole remains positioned at the location, measuring pressure of the formation fluid drawn into the pressure test chamber and operating a first pump to route additional formation fluid from the formation through the downhole tool and out into the wellbore. Still further, the method includes operating a second pump to expel the formation fluid from the pressure test chamber and to mix the formation fluid with the additional formation fluid such that the formation fluid expelled from the pressure test chamber is also routed through the downhole tool and out into the wellbore along with the additional formation fluid.

11 Claims, 10 Drawing Sheets

(56) References Cited

U.S. PATENT DOCUMENTS

| | | | |
|---|---|---|---|
| 6,609,568 | B2 | 8/2003 | Krueger et al. |
| 6,640,908 | B2 | 11/2003 | Jones et al. |
| 6,832,515 | B2 | 12/2004 | Follini et al. |
| 6,843,118 | B2 | 1/2005 | Weintraub et al. |
| 6,871,713 | B2 | 3/2005 | Meister et al. |
| 6,923,052 | B2 | 8/2005 | Krueger et al. |
| 6,932,167 | B2 | 8/2005 | Proett et al. |
| 7,011,155 | B2 | 3/2006 | Meister et al. |
| 7,024,930 | B2 | 4/2006 | Follini et al. |
| 7,027,928 | B2 | 4/2006 | DiFoggio |
| 7,036,579 | B2 | 5/2006 | Follini et al. |
| 7,063,174 | B2 | 6/2006 | Chemali et al. |
| 7,117,734 | B2 | 10/2006 | Follini et al. |
| 7,121,338 | B2 | 10/2006 | van Zuilekom et al. |
| 7,124,819 | B2 | 10/2006 | Ciglenec et al. |
| 7,198,105 | B2 | 4/2007 | Grant et al. |
| 7,204,309 | B2 | 4/2007 | Segura et al. |
| 7,210,344 | B2 | 5/2007 | Follini et al. |
| 7,216,533 | B2 | 5/2007 | McGregor et al. |
| 7,222,524 | B2 | 5/2007 | Shammai |
| 7,234,521 | B2 | 6/2007 | Shammai et al. |
| 7,243,537 | B2 | 7/2007 | Proett et al. |
| 7,261,168 | B2 | 8/2007 | McGregor et al. |
| 7,263,880 | B2 | 9/2007 | Pop et al. |
| 7,266,983 | B2 | 9/2007 | Krueger et al. |
| 7,290,443 | B2 | 11/2007 | Follini et al. |
| 7,339,160 | B2 | 3/2008 | Raghuraman et al. |
| 7,395,703 | B2 | 7/2008 | Niemeyer et al. |
| 7,458,258 | B2 | 12/2008 | Xian et al. |
| 7,594,541 | B2 | 9/2009 | Ciglenec et al. |
| 7,600,420 | B2 | 10/2009 | Meek |
| 7,665,354 | B2 | 2/2010 | Shammai |
| 7,845,405 | B2 | 12/2010 | Villareal et al. |
| 7,878,244 | B2 | 2/2011 | Nold, III et al. |
| 7,937,223 | B2 | 5/2011 | Ciglenec et al. |
| 8,042,387 | B2 | 10/2011 | Zazovsky et al. |
| 2004/0221983 | A1* | 11/2004 | Ma ..... E21B 49/10 166/100 |
| 2007/0114021 | A1 | 5/2007 | Brown et al. |
| 2007/0284099 | A1 | 12/2007 | DiFoggio et al. |
| 2009/0250212 | A1 | 10/2009 | Bittleston et al. |
| 2010/0089569 | A1 | 4/2010 | van Zuilekom et al. |
| 2010/0132941 | A1 | 6/2010 | van Zuilekom et al. |
| 2011/0094733 | A1 | 4/2011 | Proett |
| 2011/0100623 | A1 | 5/2011 | Bebb |
| 2011/0100641 | A1 | 5/2011 | Briquet et al. |
| 2011/0114310 | A1* | 5/2011 | Ross ..... E21B 49/10 166/250.17 |

OTHER PUBLICATIONS

Hashem et al., "Wireline Formation Testers: Uses Beyond Pressures and Fluid Samples—a Viable Replacement of Production Tests," paper for presentation at SPWLA 43rd Annual Logging Symposium, Jun. 2-5, 2002.

Kin et al., "Comparing Wireline Formation Tester Derived Productivity Index to Drill Stem Test" (SPE 130868), paper for presentation at SPE Asia Pacific Oil and Gas Conference and Exhibition in Brisbane, Australia, Oct. 18-20, 2010.

Raghuraman et al., "Real-Time Downhole pH Measurement Using Optical Spectroscopy" (SPE 93057), SPE Reservoir Evaluation & Engineering, Jun. 2007, pp. 302-311.

Villareal et al., "Characterization of Sampling while Drilling Operations" (IADC/SPE 128249), paper for presentation at 2010 IADC/SPE Drilling Conference and Exhibition in New Orleans, Louisiana, Feb. 2-4, 2010.

International Search Report and Written Opinion of corresponding PCT Application Serial No. PCT/US2014/045128, 11 pages.

* cited by examiner

PUMP CONTROL FOR AUXILIARY FLUID MOVEMENT

BACKGROUND

Wells are generally drilled into subsurface rocks to access fluids, such as hydrocarbons, stored in subterranean formations. The formations penetrated by a well can be evaluated for various purposes, including for identifying hydrocarbon reservoirs within the formations. During drilling operations, one or more drilling tools in a drill string may be used to test or sample the formations. Following removal of the drill string, a wireline tool may also be run into the well to test or sample the formations. These drilling tools and wireline tools, as well as other wellbore tools conveyed on coiled tubing, drill pipe, casing or other means of conveyance, are also referred to herein as "downhole tools." Certain downhole tools may include two or more integrated collar assemblies, each for performing a separate function, and a downhole tool may be employed alone or in combination with other downhole tools in a downhole tool string.

Formation evaluation may involve stationing a downhole tool at different locations within a well and measuring formation pressures at those locations. In some instances, an intake of the downhole tool can be hydraulically coupled to a formation and a pretest may be performed to measure the formation pressure and mobility. More specifically, during a pretest, fluid can be drawn from the formation into the tool through the intake by creating a negative pressure differential between the formation and the tool interior (referred to as a drawdown), and formation fluid drawn into the tool causes the pressure to gradually increase (referred to as a buildup) toward the formation pressure. Pumps within the tool can be used to initiate a drawdown and to route fluids within the tool. The measured formation pressures can facilitate reservoir characterization and be used to optimize subsequent activities at the well.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In one embodiment of the present disclosure, a method includes drawing formation fluid from a formation into a pressure test chamber of a downhole tool while the downhole tool is positioned at a location within a wellbore. The method also includes, while the downhole remains positioned at the location, measuring pressure of the formation fluid drawn into the pressure test chamber and operating a first pump to route additional formation fluid from the formation through the downhole tool and out into the wellbore. Still further, the method includes operating a second pump to expel the formation fluid from the pressure test chamber and to mix the formation fluid with the additional formation fluid such that the formation fluid expelled from the pressure test chamber is also routed through the downhole tool and out into the wellbore along with the additional formation fluid.

In another embodiment, a method includes moving a piston within a chamber of a downhole tool to push a fluid out of the chamber and into a flowline. This method also includes using a pump in the downhole tool and in fluid communication with the flowline to route the fluid within the downhole tool via the flowline while moving the piston within the chamber.

Additionally, another embodiment includes a downhole tool having an intake for receiving formation fluid within a flowline of the downhole tool. This downhole tool also includes an auxiliary fluid chamber and a flowline pump each in fluid communication with the flowline. Still further, the downhole tool of this embodiment includes an auxiliary pump positioned to expel auxiliary fluid from the auxiliary fluid chamber and a controller that can control mixing of the auxiliary fluid from the auxiliary fluid chamber with the formation fluid received through the intake via simultaneous operation of the flowline pump and the auxiliary pump.

Various refinements of the features noted above may exist in relation to various aspects of the present embodiments. Further features may also be incorporated in these various aspects as well. These refinements and additional features may exist individually or in any combination. For instance, various features discussed below in relation to the illustrated embodiments may be incorporated into any of the above-described aspects of the present disclosure alone or in any combination. Again, the brief summary presented above is intended just to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

It is to be understood that the present disclosure provides many different embodiments, or examples, for implementing different features of various embodiments. Specific examples of components and arrangements are described below for purposes of explanation and to simplify the present disclosure. These are, of course, merely examples and are not intended to be limiting.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not mandate any particular orientation of the components.

Figure 1:
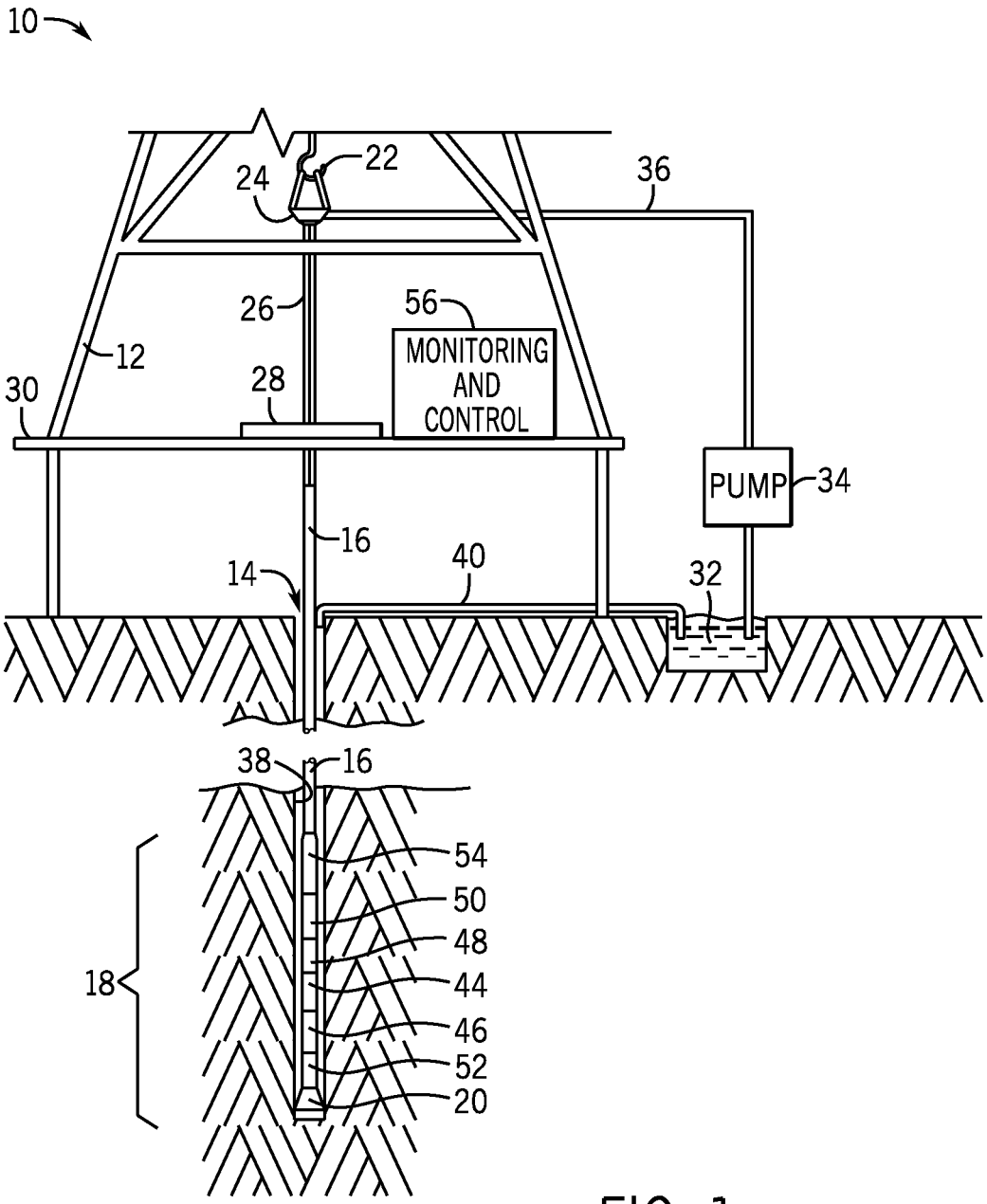
FIG. 1 generally depicts a drilling system having a tool in a drill string for measuring formation pressures in accordance with one embodiment of the present disclosure.

As generally noted above, formation pressures (as well as other parameters) can be measured within a well to facilitate reservoir characterization and to optimize further well activity (e.g., drilling, completion, or production at the well). Downhole tools are deployed in various ways to measure formation pressures. By way of example, and now turning to the drawings, a drilling system 10 with such a downhole tool is depicted in FIG. 1 in accordance with one embodiment. While certain elements of the drilling system 10 are depicted in this figure and generally discussed below, it will be appreciated that the drilling system 10 may include other components in addition to, or in place of, those presently illustrated and discussed. As depicted, the system 10 includes a drilling rig 12 positioned over a well 14. Although depicted as an onshore drilling system 10, it is noted that the drilling system could instead be an offshore drilling system. The drilling rig 12 supports a drill string 16 that includes a bottomhole assembly 18 having a drill bit 20. The drilling rig 12 can rotate the drill string 16 (and its drill bit 20) to drill the well 14.

The drill string 16 is suspended within the well 14 from a hook 22 of the drilling rig 12 via a swivel 24 and a kelly 26. Although not depicted in FIG. 1, the skilled artisan will appreciate that the hook 22 can be connected to a hoisting system used to raise and lower the drill string 16 within the well 14. As one example, such a hoisting system could include a crown block and a drawworks that cooperate to raise and lower a traveling block (to which the hook 22 is connected) via a hoisting line. The kelly 26 is coupled to the drill string 16, and the swivel 24 allows the kelly 26 and the drill string 16 to rotate with respect to the hook 22. In the presently illustrated embodiment, a rotary table 28 on a drill floor 30 of the drilling rig 12 is constructed to grip and turn the kelly 26 to drive rotation of the drill string 16 to drill the well 14. In other embodiments, however, a top drive system could instead be used to drive rotation of the drill string 16.

During operation, drill cuttings or other debris may collect near the bottom of the well 14. Drilling fluid 32, also referred to as drilling mud, can be circulated through the well 14 to remove this debris. The drilling fluid 32 may also clean and cool the drill bit 20 and provide positive pressure within the well 14 to inhibit formation fluids from entering the wellbore. In FIG. 1, the drilling fluid 32 is circulated through the well 14 by a pump 34. The drilling fluid 32 is pumped from a mud pit (or some other reservoir, such as a mud tank) into the drill string 16 through a supply conduit 36, the swivel 24, and the kelly 26. The drilling fluid 32 exits near the bottom of the drill string 16 (e.g., at the drill bit 20) and returns to the surface through the annulus 38 between the wellbore and the drill string 16. A return conduit 40 transmits the returning drilling fluid 32 away from the well 14. In some embodiments, the returning drilling fluid 32 is cleansed (e.g., via one or more shale shakers, desanders, or desilters) and reused in the well 14.

In addition to the drill bit 20, the bottomhole assembly 18 also includes a downhole tool with various instruments that measure information of interest within the well 14. For example, as depicted in FIG. 1, the bottomhole assembly 18 includes a logging-while-drilling (LWD) module 44 and a measurement-while-drilling (MWD) module 46. Both modules include sensors, housed in drill collars, that collect data and enable the creation of measurement logs in real-time during a drilling operation. The modules could also include memory devices for storing the measured data. The LWD module 44 includes sensors that measure various characteristics of the rock and formation fluid properties within the well 14. Data collected by the LWD module 44 could include measurements of formation pressure, gamma rays, resistivity, neutron porosity, formation density, sound waves, optical density, and the like. The MWD module 46 includes sensors that measure various characteristics of the bottomhole assembly 18 and the wellbore, such as orientation (azimuth and inclination) of the drill bit 20, torque, shock and vibration, the weight on the drill bit 20, and downhole temperature and pressure. The data collected by the MWD module 46 (or by other modules of the bottomhole assembly 18) can be used to control drilling operations. The bottomhole assembly 18 can also include one or more additional modules 48, which could be LWD modules, MWD modules, or some other modules. It is noted that the bottomhole assembly 18 is modular, and that the positions and presence of particular modules of the assembly could be changed as desired.

The bottomhole assembly 18 can also include other modules. As depicted in FIG. 1 by way of example, such other modules include a power module 50, a steering module 52, and a communication module 54. In one embodiment, the power module 50 includes a generator (such as a turbine) driven by flow of drilling mud through the drill string 16. In other embodiments, the power module 50 could also or instead include other forms of power storage or generation, such as batteries or fuel cells. The steering module 52 may include a rotary-steerable system that facilitates directional drilling of the well 14. The communication module 54 enables communication of data (e.g., data collected by the LWD module 44 and the MWD module 46) between the bottomhole assembly 18 and the surface. In one embodiment, the communication module 54 communicates via mud pulse telemetry, in which the communication module 54 uses the drilling fluid 32 in the drill string as a propagation medium for a pressure wave encoding the data to be transmitted.

The drilling system 10 also includes a monitoring and control system 56. The monitoring and control system 56 can include one or more computer systems that enable monitoring and control of various components of the drilling system 10. The monitoring and control system 56 can also receive data from the bottomhole assembly 18 (e.g., data from the LWD module 44, the MWD module 46, and the additional module 48) for processing and for communication to an operator, to name just two examples. While depicted on the drill floor 30 in FIG. 1, it is noted that the monitoring and control system 56 could be positioned elsewhere, and that the system 56 could be a distributed system with elements provided at different places near or remote from the well 14.

Figure 2:
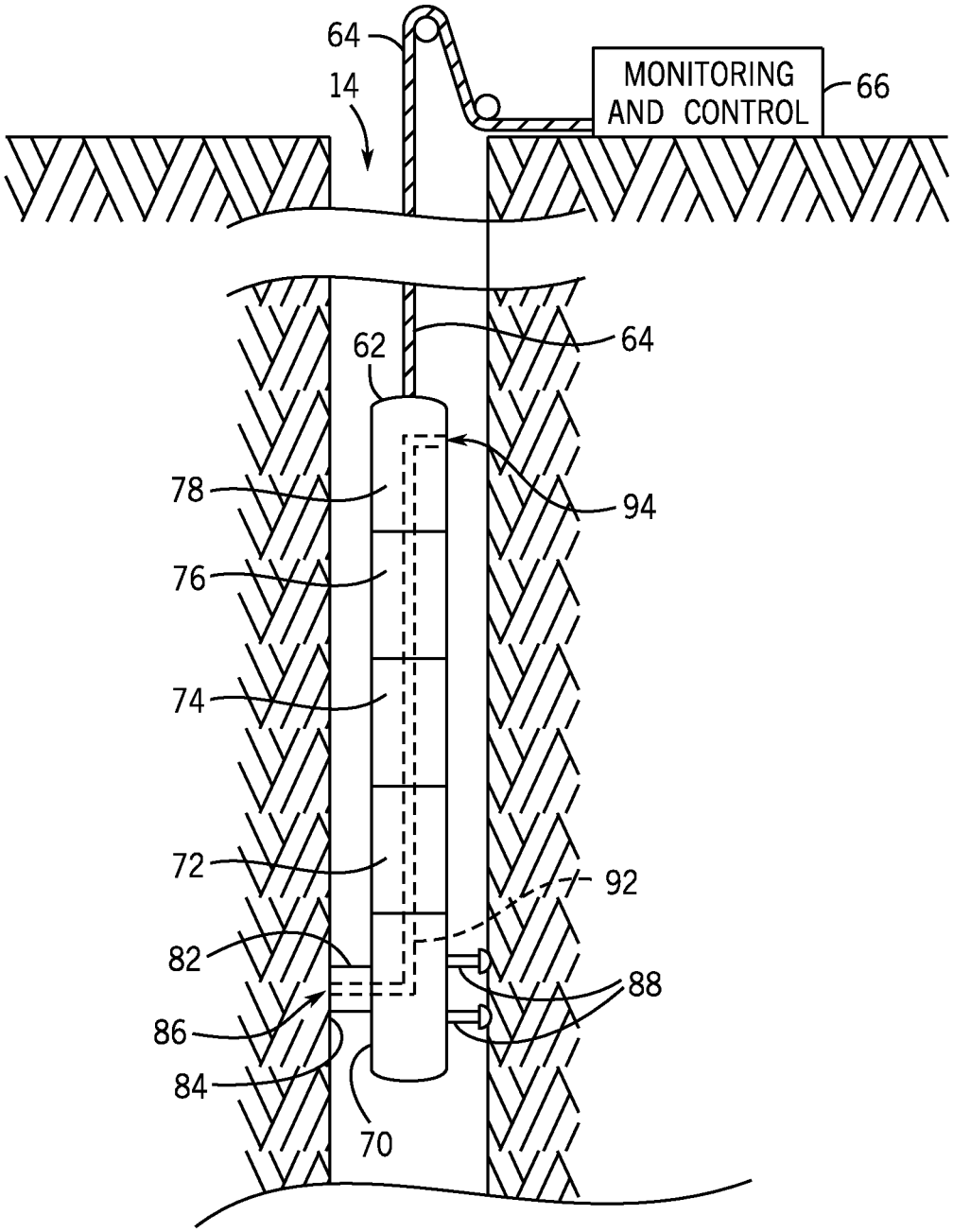
FIG. 2 generally depicts a tool deployed within a well on a wireline for measuring formation pressures in accordance with one embodiment.

Another example of using a downhole tool for formation testing within the well 14 is depicted in FIG. 2. In this embodiment, a testing tool 62 is suspended in the well 14 on a cable 64. The cable 64 may be a wireline cable with at least one conductor that enables data transmission between the testing tool 62 and a monitoring and control system 66. The cable 64 may be raised and lowered within the well 14 in any suitable manner. For instance, the cable 64 can be reeled from a drum in a service truck, which may be a logging truck having the monitoring and control system 66. The monitoring and control system 66 controls movement of the testing tool 62 within the well 14 and receives data from the tool 62. In a similar fashion to the monitoring and control system 56 of FIG. 1, the monitoring and control system 66 may include one or more computer systems or devices and may be a distributed computing system. The received data can be stored, communicated to an operator, or processed, for instance. While the testing tool 62 is here depicted as being deployed by way of a wireline, in some embodiments the tool 62 (or at least its functionality) is incorporated into or as one or more modules of the bottomhole assembly 18 of the drill string 16, such as the LWD module 44 or the additional module 48.

The testing tool 62 can take various forms. While it is depicted in FIG. 2 as having a body including a probe module 70, a fluid analysis module 72, a pump module 74, a power module 76, and a fluid storage module 78, the testing tool 62 may include different modules in other embodiments. The probe module 70 includes a probe 82 that may be extended (e.g., hydraulically driven) and pressed into engagement against a wall 84 of the well 14 to hydraulically couple the probe to a formation and to draw fluid from the formation into the testing tool 62 through an intake 86. As depicted, the probe module 70 also includes setting pistons 88 that may be extended outwardly to engage the wall 84 and push the end face of the probe 82 against another portion of the wall 84. In some embodiments, the probe 82 includes a sealing element or packer that isolates the intake 86 from the rest of the wellbore. In other embodiments, the testing tool 62 could include one or more inflatable packers that can be extended from the body of the tool 62 to circumferentially engage the wall 84 and isolate a region of the well 14 near the intake 86 from the rest of the wellbore. In such embodiments, the extendable probe 82 and setting pistons 88 could be omitted and the intake 86 could be provided in the body of the testing tool 62, such as in the body of a packer module housing an extendable packer. Further, in certain embodiments, the intake may be provided within a packer (e.g., as a drain within a single packer) that can be expanded to press the intake against the wall 84.

The pump module 74 draws fluid from the formation into the intake 86, through a flowline 92, and then either out into the wellbore through an outlet 94 or into a storage container (e.g., a bottle within fluid storage module 78) for transport back to the surface when the testing tool 62 is removed from the well 14. The fluid analysis module 72 includes one or more sensors for measuring properties of the drawn formation fluid (e.g., fluid density, optical density, and pressure) and the power module 76 provides power to electronic components of the testing tool 62.

The drilling and wireline environments depicted in FIGS. 1 and 2 are examples of environments in which a testing tool may be used to facilitate analysis of a downhole fluid. The presently disclosed techniques, however, could be implemented in other environments as well. For instance, the testing tool 62 may be deployed in other manners, such as by a slickline, coiled tubing, or a pipe string. Moreover, the presently disclosed techniques may be employed for fluid sampling applications in other environments outside of the oilfield.

As noted above, the testing tool 62 can take various forms. In one embodiment, generally depicted in FIG. 3 as a testing tool 100, the tool includes a probe module 102, a combined pump-analysis module 104, and a fluid storage module 106. The probe module 102 includes an intake 110, which can be provided in an extendable probe as described above with respect to FIG. 2. The intake 110 allows fluid to be drawn from a formation into a flowline 112 of the tool 100. The probe module 102 can include various components. As presently depicted, the probe module 102 includes a pressure test chamber 114 (also referred to herein as a pretest chamber), a pump 116, a flowline isolation valve 118, a pretest isolation valve 120, an exhaust valve 122, a hydraulic system 124, and a pressure gauge 126, although in other embodiments the probe module 102 could include other components in addition to or in place of those generally illustrated in FIG. 3.

The tool 100 can be used to measure formation pressure by placing the intake 110 in fluid communication with the formation while isolating the intake 110 from wellbore pressure (e.g., through sealing engagement of the extendable probe against the wellbore). The pump 116 is then actuated to draw fluid into the flowline 112 and the pressure test chamber 114. Particularly, in the presently depicted embodiment, the pump 116 is provided in the form of a piston positioned within the pressure test chamber 114. With the intake 110 isolated from wellbore pressure, the flowline isolation valve 118 and the exhaust valve 122 closed, and the pretest isolation valve 120 open, the piston of pump 116 can be retracted to increase the volume of the pressure test chamber 114. As the piston is retracted in this manner, the pressure at the intake 110 falls. Once this pressure falls sufficiently below the formation pressure (in order to breach mud cake formed on the wellbore face), fluid flows from the formation into the tool 100 via the intake 110. The piston of pump 116 can then be stopped and fluid pressure within the pressure test chamber 114 increases toward equilibrium with the formation pressure as fluid from the formation passes into the tool 100 via the intake 110. The resulting pressure of the pressure test chamber 114 can then be read via the pressure gauge 126.

In one embodiment, the piston of pump 116 is actuated by routing hydraulic control fluid to and from the piston via the hydraulic system 124 (which could include, for example, a stored source of hydraulic fluid and a pump for delivering the fluid to the piston in the pressure test chamber 114). The hydraulic system 124 could be used to actuate other components of the probe module 102, such as to extend and retract a probe 82 and setting pistons 88 (FIG. 2), or to control any of the valves of the tool 100 (e.g., valves 118, 120, and 122).

The depicted probe module 102 also includes a controller 132 for operating various components of the probe module. As shown in the present figure, the controller 132 is communicatively coupled to the hydraulic system 124 to command operation of the hydraulic system 124 to actuate pump 116 or any other hydraulic components. The controller 132 can also receive pressure measurements taken by the pressure gauge 126 and use those measurements in controlling operation of the probe module 102. For example, the controller 132 can command the pump 116 to begin operating to lower the pressure within the tool (e.g., by retracting a piston in the pressure test chamber 114), detect a pressure increase (via pressure gauge 126) in the tool indicative of formation fluid breaching the mud cake and flowing into the tool 100, and then command that the pump 116 stop to allow the pressure within the pressure test chamber 114 reach equilibrium with the formation from which the fluid is drawn. As discussed in greater detail below, the controller 132 can also command the pump 116 to expel fluid from the chamber 114 for mixing with formation fluid routed through the tool by a pump 140 of the module 104. Still further, the controller 32 can control the rate at which the pump 116 operates, thereby enabling control of the rate at which fluid is expelled from the pressure test chamber 114.

Also, the controller 132 can command operation of the valves 118, 120, and 122 either directly (in the case of electromechanical valves) or via the hydraulic system 124 (in the case of hydraulically actuated valves). The flowline isolation valve 118 can be an independently controlled valve, such as a solenoid valve actuated by the controller 132 to selectively isolate other modules of the tool 100 from the intake 110. This could allow repeated pretests (with pressure measurements taken via gauge 126) without hydraulically uncoupling the intake 110 from the formation, as well as enable the tool to return to sampling or scanning of formation fluid, as described below, by other modules downstream of the valve 118 after (or between) one or more additional pretests. The pretest isolation valve 120 can be opened by the controller 132 to permit fluid communication between the pressure test chamber 114 and the flowline 112, and the exhaust valve 122 can be opened to allow fluid to be expelled into the wellbore via an outlet 130.

Figure 3:
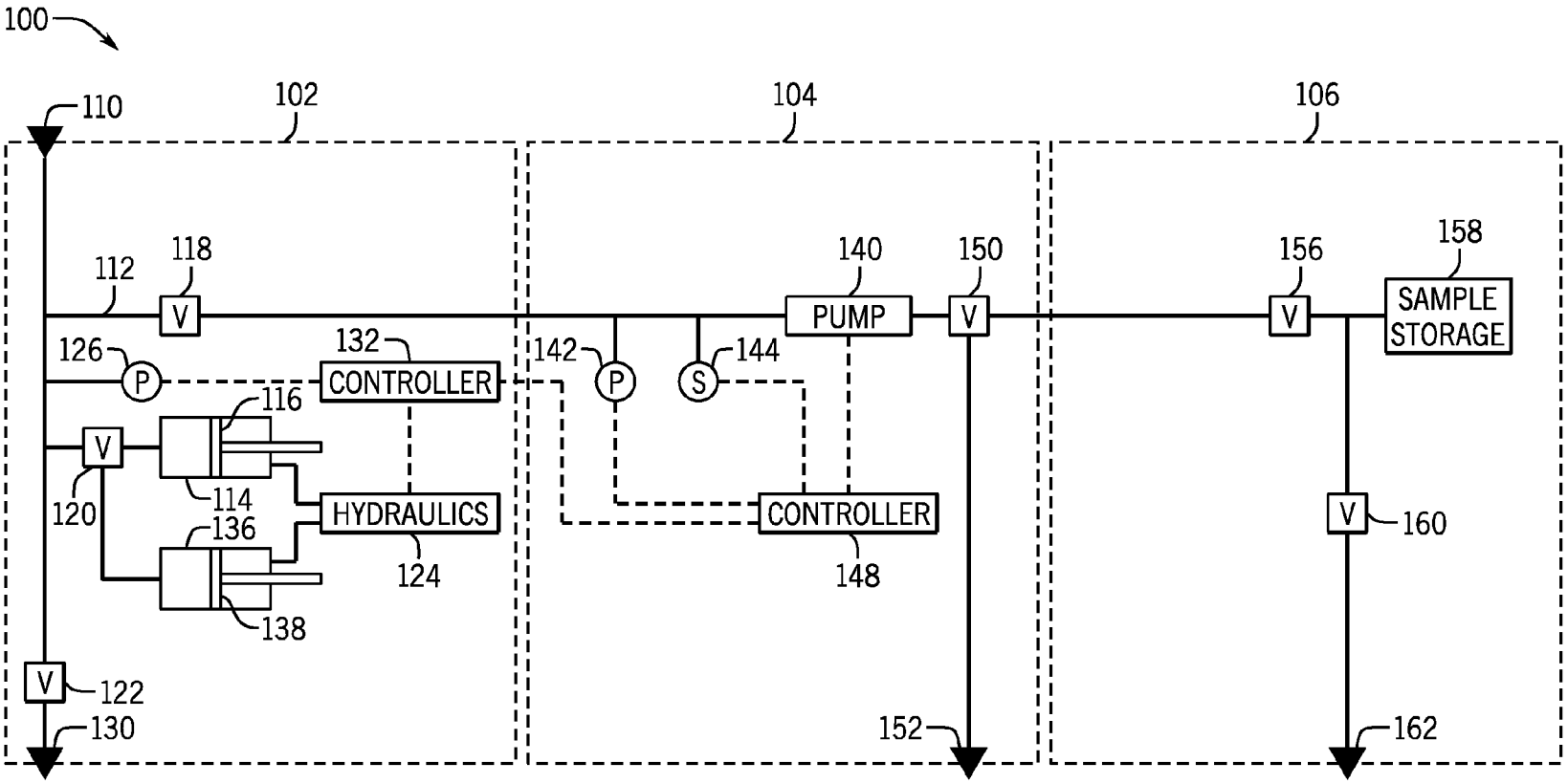
FIG. 3 is a block diagram of components of a testing tool for measuring formation pressures within a well in accordance with one embodiment.

Further, the probe module 102 depicted in FIG. 3 includes another fluid chamber 136 and associated pump 138, in addition to the pressure test chamber 114 and its pump 116. This additional fluid chamber 136 can be used for various purposes. In one instance, the chamber 136 can be used to measure formation pressure in the same way described above with respect to the pressure test chamber 114 (with the pump 138 including a piston analogous to that of the pump 116). In other instances, the chamber 136 can store a fluid for later injection into the flowline 112. Non-limiting examples of such fluids include a tracer agent, a dye (e.g., for measuring pH), or acid (e.g., for micro-fracturing via the tool 100). In those embodiments including the fluid chamber 136, the valve 120 can be a directional valve to allow selective control over routing of fluid into and out of the pressure test chamber 114 and the additional chamber 136. That is, the valve 120 can be operated to place either, both, or neither of the chambers 114 and 136 in fluid communication with the flowline 112 as desired. As with the pump 114, the controller 132 can also control operation (including speed) of the pump 138 to enable control over the rate at which fluid is expelled from the chamber 136.

The module 104 is depicted as including the pump 140, a pressure gauge 142, additional sensors 144, a controller 148, and a valve 150. The pump 140 is operable to route fluid through the tool 100 via the flowline 112 when the flowline isolation valve 118 is open. In one embodiment, the pump 140 is a dual-piston reciprocating pump in which a shared rod drives two pistons in separate chambers such that movement of the shared rod in one direction causes a suction stroke in a first chamber and a discharge stroke in a second chamber. The direction of the shared rod can be reversed to then cause a discharge stroke in the first chamber and a suction stroke in the second chamber. In other embodiments, the pump 140 can be provided in different forms. Indeed, any pump capable of routing fluid within the tool 100 could be used. Further, the pump 140 can be driven in any suitable manner. For example, in some embodiments the pump is driven by an electric motor via a screw actuator.

With the valve 118 opened, operation of the pump 140 creates a pressure differential between the formation hydraulically coupled to the intake 110 and the flowline 112 upstream of the pump 140. This generally causes fluid to flow from the formation into the flowline 112 and to be routed through the tool 100 by operation of the pump 140. The fluid pumped out of the pump 140 can be routed out into the wellbore via outlet 152 or, if desired, directed to the fluid storage module 106 by the valve 150 to enable collection of a sample of the fluid. With fluid being routed through the tool 100 by the pump 140, properties of the fluid can be measured via the pressure gauge 142 and the additional sensors 144. The additional sensors 144 can include any suitable sensors and may be used to take additional measurements related to fluid routed through the tool 100. These additional measurements could include temperature, fluid density, optical density, electrical resistivity, fluorescence, and contamination, to name but a few examples. While the module 104 is depicted as including both pumping and analytical functionality, it will be appreciated that the additional sensors 144 could instead be provided in a separate fluid analysis module of the tool 100.

The controller 148 directs operation (e.g., by sending command signals) of the pump 140 to control the flow of fluid routed through the tool by the pump 140. The controller 148 can, for example, initiate pumping by the pump 140 to begin routing formation fluid from the intake 110 through the tool 100 and vary the rate at which the pump 140 operates to control flow characteristics of the routed fluid. The controller 148 can also receive data from the pressure gauge 142 and the additional sensors 144. This data can be stored by the controller 148 or communicated to another controller or system for analysis. In at least one embodiment, the controller 148 also analyzes data received from the pressure gauge 142 or from the additional sensors 144. For example, the controller can vary operation of the pump 140 based on pressure measurements obtained with the pressure gauge 142, and can operate the valve 150 to divert fluid to storage devices 158 of the fluid storage module 106 based on analysis of the collected data indicating that collection of a fluid sample is desired. The storage devices 158 can include bottles or any other suitable vessels for retaining fluid samples for later retrieval at the surface. In at least some embodiments, the valve 156 is a check valve to inhibit flow from the module 106 to the module 104, and the valve 160 is a pressure relief valve to enable fluid to vent from the module 106 to the wellbore via outlet 162 if the pressure exceeds a given threshold.

Figure 4:
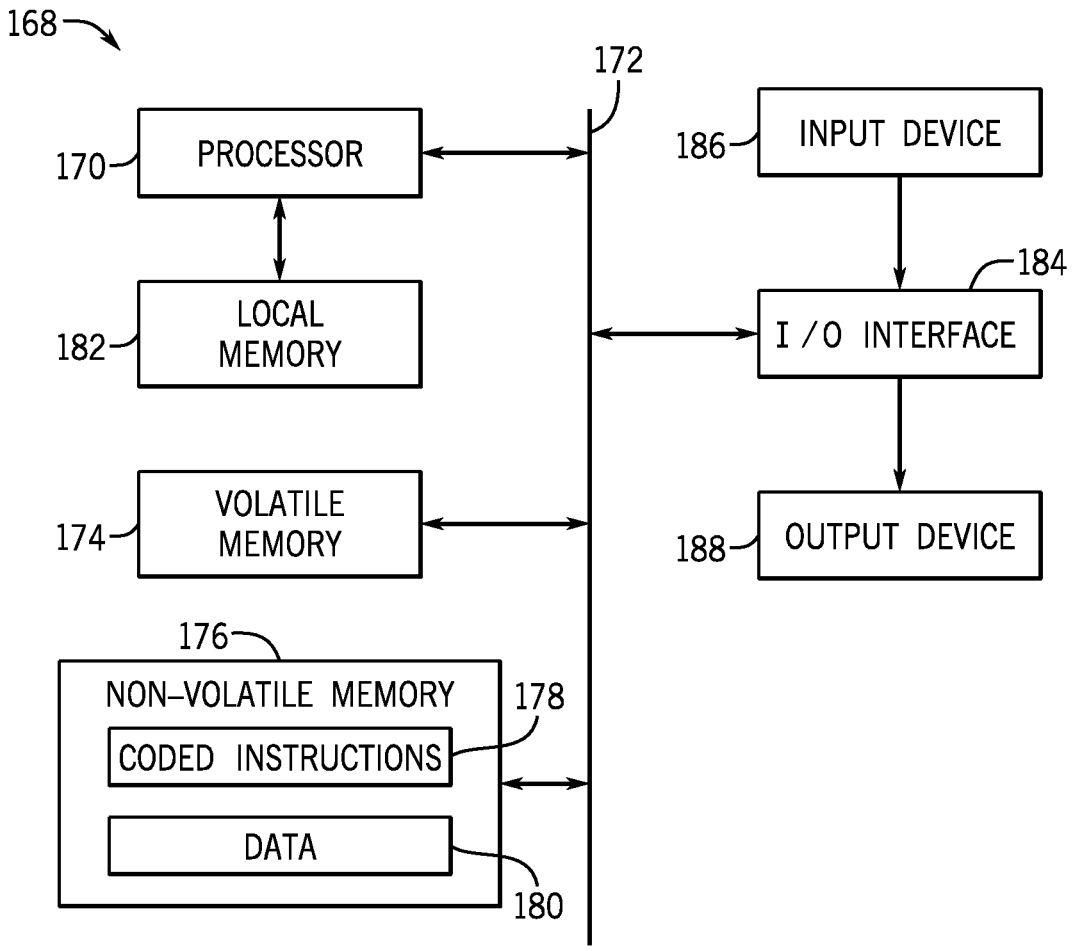
FIG. 4 is a block diagram of components in one example of a controller included in the testing tool of FIG. 3.

The controllers 132 and 148 of at least some embodiments are processor-based systems, an example of which is provided in FIG. 4 and referred to as controller 168. In this depicted embodiment, the controller 168 includes at least one processor 170 connected, by a bus 172, to volatile memory 174 (e.g., random-access memory) and non-volatile memory 176 (e.g., flash memory and a read-only memory (ROM)). Data 180 and coded application instructions 178 (e.g., software that may be executed by the processor 170 to enable the control and analysis functionality described herein, including the coordinated control of pump 140 with one or both of pumps 116 and 138) are stored in the non-volatile memory 176. For example, the application instructions 178 can be stored in a ROM and the data can be stored in a flash memory. The instructions 178 and the data 180 may be also be loaded into the volatile memory 174 (or in a local memory 182 of the processor) as desired, such as to reduce latency and increase operating efficiency of the controller 168. An interface 184 of the controller 168 enables communication between the processor 170 and various input devices 186 and output devices 188. The interface 184 can include any suitable device that enables such communication, such as a modem. In some embodiments, the input devices 186 include one or more sensing components of the tool 100 (e.g., the pressure gauge 126, the pressure gauge 142, or an additional sensor 144) and the output devices 188 include the pumps 116, 138, and 140; the valves 118, 120, 122, and 150; and the hydraulic system 124. The output devices 188 could also include displays, printers, and storage devices that allow output of data received or generated by the controller 168.

In at least some embodiments, multiple pumps (e.g., pumps 116 and 140 of FIG. 3) are operated simultaneously to route fluid within the downhole tool 100. The simultaneous operation of these pumps can be coordinated with the controllers 132 and 148 to mix fluid from a chamber in the tool (e.g., pressure test chamber 114 or chamber 136) with fluid being pumped from a formation through the tool 100 via the intake 110. Further, the controllers can vary operation of the pumps to regulate the flowline pressure or the rate at which the fluids are mixed.

Figure 5:
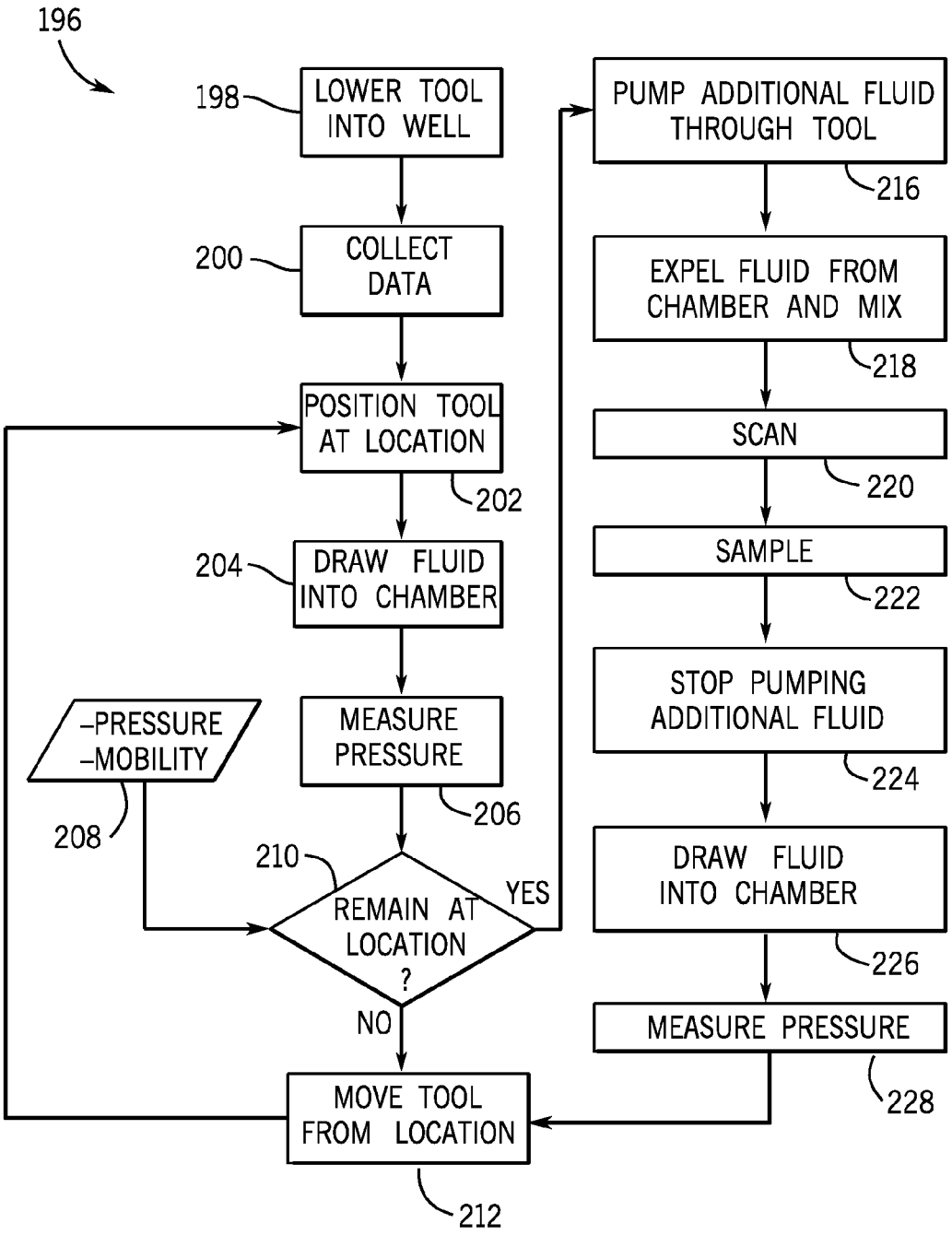
FIG. 5 is a flow chart for measuring formation pressures in accordance with one embodiment.

With the foregoing in mind, one example of a process for operating a downhole tool to measure formation pressures within a well is generally represented by flow chart 196 in FIG. 5. In this embodiment, a downhole tool (e.g., tool 100) is lowered into a well (block 198). For measurement during a drilling process, the downhole tool can be integrated into a drill string within the well. In other instances, however, the downhole tool can be lowered in some other manner (e.g., by wireline, slickline, or coiled tubing). As the tool 100 is lowered into the well, the tool collects various data (block 200). Such data can include, for example, open-hole logs detailing any of numerous measurable parameters (e.g., electrical resistivity, density, and gamma radiation) for a formation through which the well passes.

As represented at block 202, the tool 100 is positioned at a location (also referred to herein as a testing station) to prepare for a pretest. The intake 110 can be hydraulically coupled to an adjacent formation (such as by extending a probe from the body of the tool 100 to engage the wall of the wellbore) and, at block 204, a pretest is begun by drawing fluid into a chamber (e.g., the pressure test chamber 114) from the formation. The fluid can be drawn into the chamber in any suitable manner, such as by retracting a piston within the chamber 114, as described above. During the pretest, the pressure of the fluid drawn into the chamber is then measured at block 206 (which can be used to measure the change in pressure over time to also determine mobility). Based on the measured data (e.g., pressure, mobility, or some other parameter derived therefrom, with such data collectively represented by input block 208), the process includes determining (block 210) whether to keep the tool 100 at the location. Such a determination can be made by one of the controllers of the tool 100 or by a separate system (e.g., the monitoring and control system 56 or 66). In the event that no further activity by the tool 100 at that location is desired at that time, the tool can be moved from the location (block 212).

In other instances, however, it may be desirable to keep the tool at the location to enable additional activities to occur at that location. For example, it may be desirable to route additional fluid from the formation through the tool 100 via the intake 110 (block 216) to enable the tool to scan the fluid (e.g., with additional sensors 144) for data (block 220) or to collect a sample of the formation fluid (block 222).

It will be appreciated that wells are often kept in a state of overbalance, in which the pressure of drilling mud in the well is kept above the formation pressure to inhibit hydrocarbons or other fluids from flowing into the well. This can result in the well having an invaded zone in which drilling mud has pressed into the wall of the wellbore. To obtain more accurate measurements while scanning and a cleaner fluid for sampling, fluid from the formation may be routed through the tool 100 (e.g., with pump 140) in a cleanup phase to reduce the amount of drilling mud present in the drawn formation fluid.

As represented by block 218, the method also includes expelling the fluid drawn into the chamber (at block 204) and mixing the expelled fluid with the fluid being pumped through the tool 100 from the formation (at block 216). This expelling of the fluid from the chamber for mixing with the fluid being pumped through the tool from the formation can be performed at any desired time, such as during a cleanup phase. In at least one instance, such expelling and mixing is performed by discharging pretest fluid from the chamber 114 into the flowline 112 with a piston (of pump 116), and the pump 140 provides the motive force to draw the expelled fluid, along with the fluid already being routed from the formation, through the downhole tool 100 and out into the wellbore. The operating speed of the pump 140 can also be controlled (e.g., via controller 148) to compensate for the extra fluid being injected into the flowline from the chamber 114 and avoid injecting the pretest fluid from the chamber 114 back into the formation (which could disturb the formation or disrupt a seal about the intake 110). In this way, the fluid drawn into the chamber 114 for a pretest can be removed from the chamber 114 while formation fluid is being routed through the tool with the pump 140 to prepare the chamber 114 for another pretest, at the same testing location as an initial pretest, after scanning or sampling the formation fluid.

As generally depicted at blocks 224, 226, and 228 of FIG. 5, such an additional pretest can be performed by stopping the pumping of fluid from the formation through the tool and then again drawing formation fluid into the chamber and measuring pressure of the drawn fluid. Due to contamination of the formation fluid with drilling mud, the pretest performed at blocks 204 and 206 may be subject to capillary pressure effects in some instances (e.g., in the case in which the drawn formation fluid is oil and the drilling mud is water-based, or in the case in which the drawn formation fluid is water and the drilling mud is oil-based) that impact the measured formation pressure. Routing the formation fluid through the tool at block 216 can reduce (over time) the amount of drilling mud present in the fluid drawn from the formation. Consequently, the later pretest performed at blocks 226 and 228 (after routing fluid from the formation through the tool) may exhibit reduced error from capillary pressure effects and provide more accurate formation pressure and mobility measurements. After finishing at a given location (whether after just a single pretest, or after routing fluid through the tool and performing multiple pretests), the tool can be moved away from that location. For instance, the tool can be positioned at one or more other locations to repeat method 196 at those additional locations.

Figure 6:
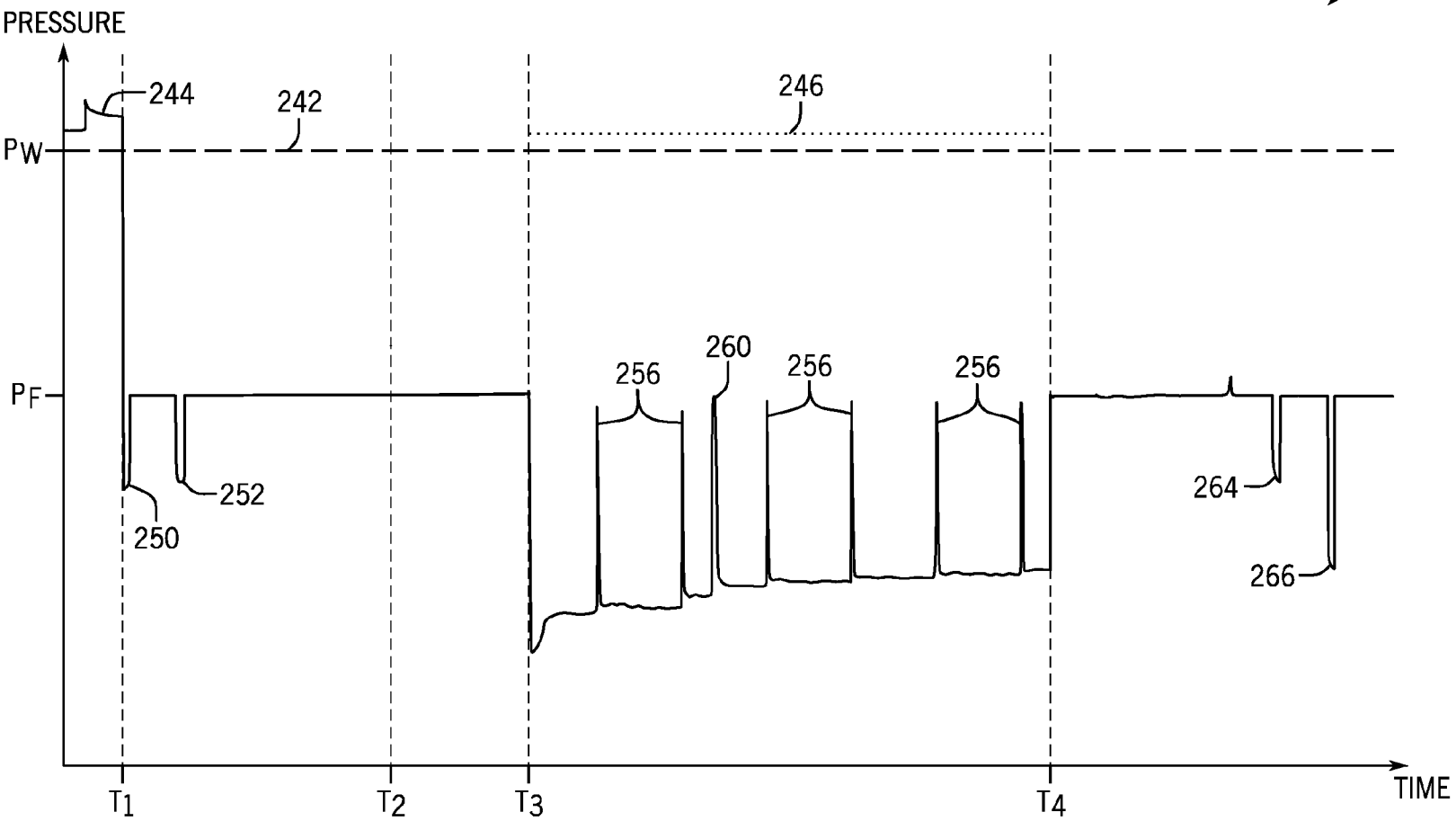
FIG. 6 is a graph representing various downhole pressures that may be present during the measurement of formation pressures in accordance with the embodiment of FIG. 5.

Operation of the tool 100 to conduct pretests and route fluid through the testing tool may be better understood with reference to FIG. 6, which is a graph generally depicting measured pressures during multiple pretests and routing of fluid through the tool in accordance with the method described above. This graph shows three pressures: a wellbore pressure 242 (generally measured at a pressure level $P_W$), a pressure 244 measured within the tool (e.g., by pressure gauge 126), and an output pressure 246 of fluid pumped into the wellbore from the tool (e.g., by pump 140). The tool is initially set at a testing station, such as by extending a probe to engage the wall of the wellbore, before time $T_1$. Once set, an initial pretest begins at time $T_1$ by starting a drawdown (e.g., by retracting the piston of pump 116) to reduce the pressure in the pressure test chamber 114 and in the conduit to the intake 110. This pressure drop 250 causes formation fluid to flow through the intake 110 into the tool 100, generally causing the pressure 244 to equalize with that of the formation ($P_F$). A second drawdown can be performed (corresponding to pressure drop 252), followed by another buildup back to the formation pressure. The formation pressure can be measured during the initial pretest before opening the valve 118 at time $T_2$. Before opening the valve 118, in at least one embodiment the controller 148 acquires the formation pressure via the controller 132 or directly from the pressure gauge 126. The pump 140 can then be operated to drawdown pump inlet pressure (measured by the gauge 142) and balance the pressure across the valve 118 so as to avoid a pressure spike when opening the valve 118.

At time $T_3$ the pump 140 begins pumping fluid from the formation via intake 110, through the tool, and out into the wellbore. The pump 140 can be operated at any desired rate, and in one embodiment the pump 140 operates at a rate of one cubic centimeter per second. Formation fluid is pumped through the tool with pump 140 from time $T_3$ to time $T_4$, with a resulting pump output pressure 246 over this time period. The pressure 244 includes pressure spikes 256 corresponding to the reversal of the direction of travel of a piston in the pump 140. The pressure 244 also includes a spike 260 corresponding to the expulsion of the pretest fluid from the chamber 114 into the flowline 112 for mixing with the formation fluid already being pumped by the pump 140. The expulsion of the pretest fluid from the chamber 114 may be timed to occur between changes of direction of the piston in the pump 140 so as to avoid aggregating the pressure effects from both the expulsion and the change in direction. The fluid pumped through the tool between times $T_3$ and $T_4$ can be scanned or sampled, as described above. At time $T_4$, the valve 118 is closed and an additional pretest can be performed by drawing down and building up pressure (see pressure drops 264 and 266) within the tool in the same manner as described above.

During expulsion of a fluid from the chamber 114 (or from the chamber 136), the tool can control the pumping of fluid within the tool to regulate the mixing of the expelled fluid with the fluid being drawn through the tool from the intake 110. Such regulation can be performed in various ways, including a constant rate mode or a constant pressure mode. Two examples of methods for regulating the mixing of the fluids under a constant rate mode and under a constant pressure mode are generally represented in FIGS. 7 and 8.

Figure 7:
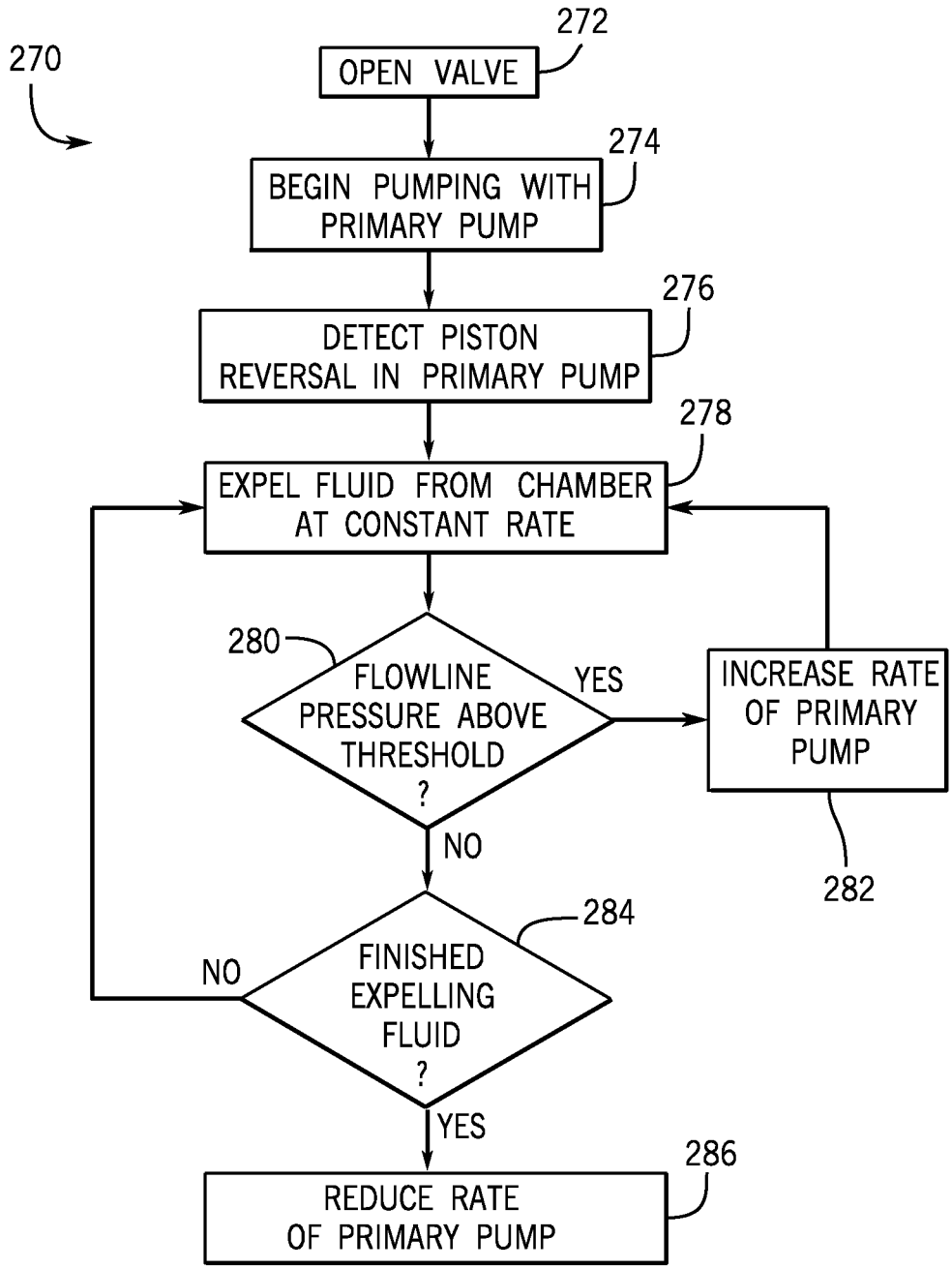
FIGS. 7 and 8 are flow charts representing pumping of fluids in a downhole tool in a constant rate mode and a constant pressure mode in accordance with certain embodiments.

In FIG. 7, a flow chart 270 representative of a method of operating tool 100 under a constant rate mode includes opening the valve 118 (block 272) and beginning to pump fluid (block 274) from the formation via the intake 110 with the pump 140 (referred to in FIG. 7 as a primary pump, and which could also be referred to as the sampling pump). Reversal of a piston in the pump 140 is detected at block 276, and at block 278 fluid begins to be expelled from a chamber in the tool (e.g., from pressure test chamber 114 or chamber 136 by pump 116 or pump 138) into the flowline 112 at a constant rate, such as one cubic centimeter per second. As noted above, expulsion of the fluid from the chamber can be timed such that, once started, the fluid is expelled from the chamber before the piston in the pump 140 reverses direction. To avoid injecting the expelled fluid back into the formation, the pressure in flowline 112 is maintained below the formation pressure. In the present embodiment, the pumping rate of the pump 140 is increased (block 282) if the flowline pressure exceeds a set threshold (block 280). The threshold may be set at any desired level, such as the formation pressure itself or a fraction of the formation pressure. Increasing the rate of the pump 140 lowers the pressure in the flowline 112 between the intake 110 and the pump 140, causing the pump 140 to pull more fluid (including that expelled from the chamber) away from the formation. This regulation can continue until the pump 116 or pump 138 has finished (block 284) expelling fluid from its respective chamber 114 or 136. In other embodiments, the pumping rate of the pump 140 is automatically increased when the pump 116 or pump 138 begins to expel fluid from its respective chamber. If the pumping rate of the pump 140 was increased at block 282 (or automatically in response to operation of the pump 116 or 138), the pump 140 may return (block 286) to its initial pumping rate after the fluid in the chamber 114 or 136 has been expelled.

Figure 8:
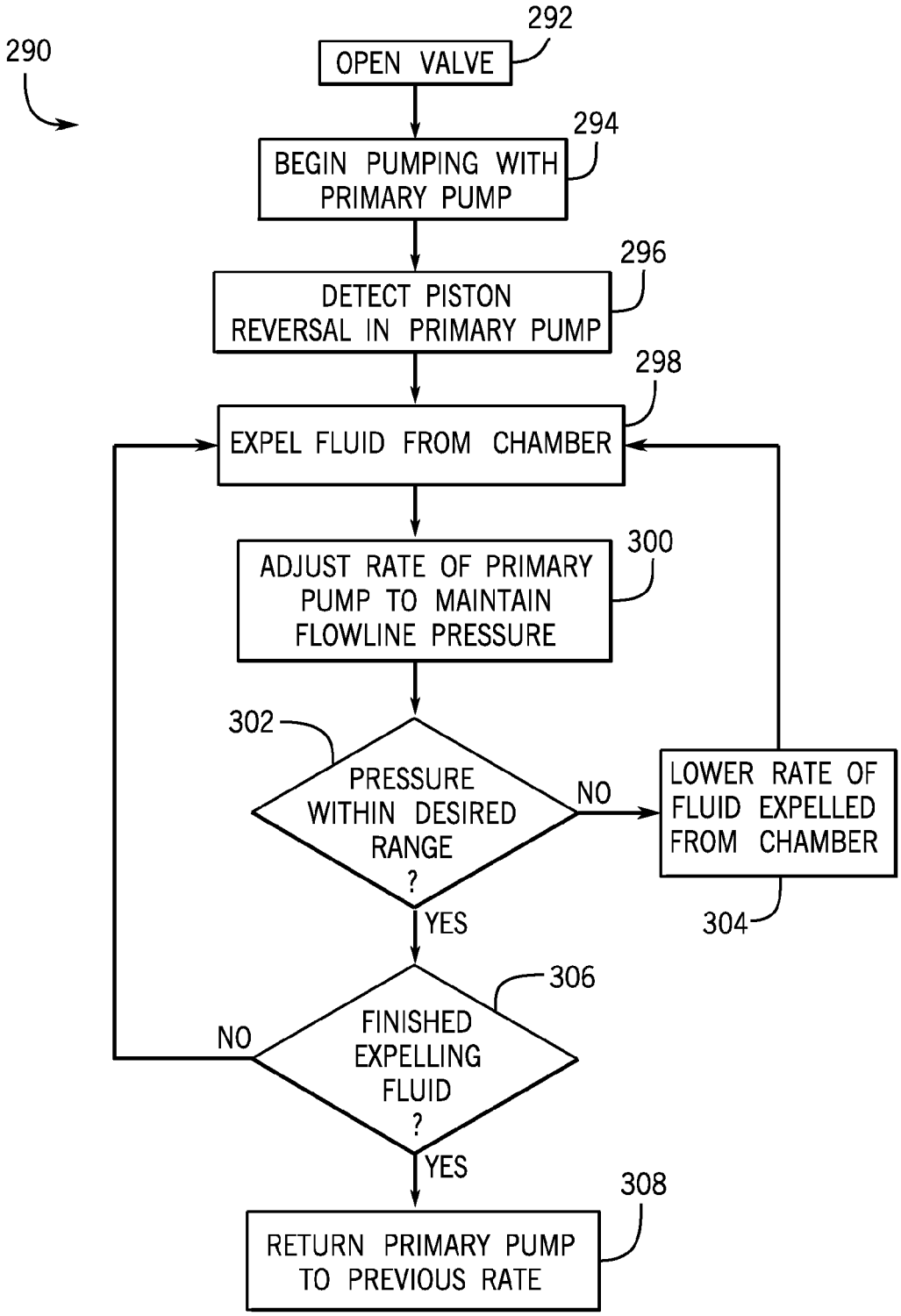

A flow chart 290 representative of a method of operating tool 100 in a constant pressure mode is provided in FIG. 8. The method includes opening the valve 118 (block 292), beginning to pump fluid (block 294) from the formation via the intake 110 with the pump 140, and detecting reversal of a piston in the pump 140 (block 296), as described above with respect to FIG. 7. Fluid in the chamber 114 or 136 begins to be expelled (via pump 116 or 138) into the flowline 112 at block 298. Again, expulsion of the fluid from the chamber can be timed to occur between reversals of the piston in the pump 140.

At block 300, the pumping rate of the pump 140 is adjusted to maintain flowline pressure at desired level (or within a desired range). For instance, the beginning of the operation of pump 116 or 138 to expel fluid from the chamber 114 or 136 can be recognized by the controller 148 that operates the pump 140 (e.g., by detecting a corresponding increase in flowline pressure or through communication with the controller 132 that operates pumps 116 and 138), and the controller 148 can control the pumping rate of the pump 140 so as to maintain the pressure read by pressure gauge 142 at a desired level. This facilitates expulsion of the fluid from chamber 114 or 136 at a varying rate, such as by starting at a slower, initial rate and then increasing to more quickly mix the expelled fluid into the flowline 112. Although the controllers 132 and 148 can communicate with one another to coordinate control of their respective pumps, in at least some instances the controllers 132 and 148 can operate independently in a constant pressure mode (with the controller 148 automatically varying operation of the pump 140 based on measurements from pressure gauge 142). If the flowline pressure deviates from a desired level or range (block 302) and cannot be maintained by adjusting the rate of the pump 140, the pumping rate of the pump 116 or 138 can be lowered to reduce the rate at which fluid is expelled into the flowline 112 from the chamber 114 or 136 (block 304). After the pump 116 or 138 is finished expelling fluid from the chamber 114 or 136 (block 306), the pumping rate of the pump 140 can return to a previous level (block 308).

The various techniques described herein for routing fluids within the tool 100 can be used to route not just fluids through and out of the tool 100, but also to move such fluids between different portions within the tool 100. Additionally, while certain examples are described with respect to mixing formation fluids drawn into and expelled from a pressure test chamber with formation fluids being drawn through the tool from an intake, it will be appreciated that other fluids (e.g., dye, acid, and fluid samples) could be similarly routed within the tool through simultaneous operation of multiple pumps. As used herein, the term "auxiliary fluid" means a fluid stored within a chamber of a downhole tool other than formation fluid being flushed through the downhole tool (that is, being routed directly from an intake to an outlet of the downhole tool). The term includes, for example, pretest fluid drawn from a formation into the pressure test chamber 114, formation fluid received in a storage bottle of the tool, and non-formation fluids stored in a chamber of the tool. With this understanding, the chambers 114 and 136, as well as storage devices 158 of the fluid storage module 106, are also referred to herein as "auxiliary fluid chambers," and pumps that control expulsion of auxiliary fluid from such chambers are referred to herein as "auxiliary pumps."

Pretests performed at multiple testing stations within the well can be used to characterize a reservoir, and such characterization can be used to inform future drilling, completion, and production activities. In some instances, formation pressure can be measured during initial pretests at multiple testing stations following setting of a downhole tool against the face of the wellbore and before scanning or sampling at each station. A formation pressure gradient representative of changes of formation pressure as a function of depth can be determined from the formation pressure measurements collected during the initial pretests. These formation pressure measurements, however, can be subject to capillary pressure effects that introduce error into the measurements. Particularly, the invasion of drilling mud into the wall of the wellbore can cause the fluid drawn from a formation in an initial pretest to include a fluid interface (with an associated capillary pressure) of drilling mud and formation fluid when the drilling mud and the formation fluid are at least partially immiscible. For example, such a fluid interface can be caused by the invasion of water-based drilling mud into an oil zone of the formation or by the invasion of oil-based drilling mud into a water zone of the formation.

In at least some embodiments, a downhole tool remains at a testing station after an initial pretest to perform an additional pretest after formation fluid has been routed through the downhole tool (e.g., in a cleanup phase) to break the capillary pressure between immiscible fluids, reduce error associated with the capillary pressure, and provide a more accurate measurement of the formation pressure. Further, this additional formation pressure measurement can be used to calibrate the formation pressure gradient determined from other formation pressure measurements taken during the initial pretests. The calibrated formation pressure gradient can then be used to more accurately characterize the formation, such as by deducing an oil-water boundary or some other fluid distribution property of the formation.

Figure 9:
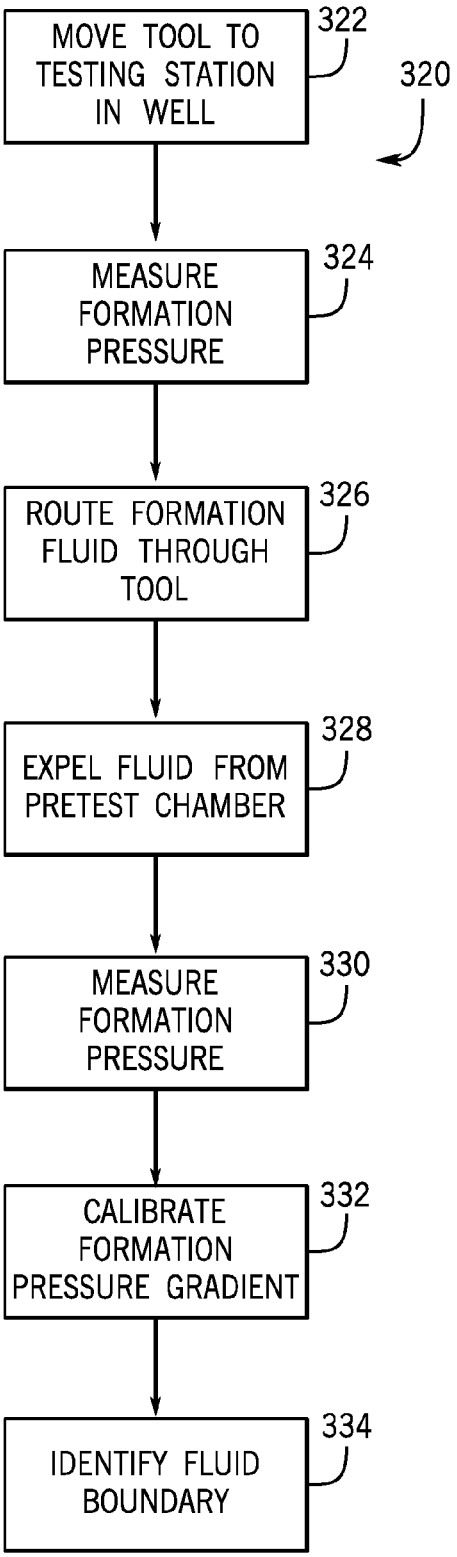
FIG. 9 is a flow chart for calibrating a formation pressure gradient in accordance with one embodiment.

In one embodiment generally represented by flow chart 320 in FIG. 9, a method includes moving a downhole tool (e.g., tool 100) to a testing station in the well (block 322). For drilling instances in which the downhole tool is incorporated into a drill string, moving the downhole tool includes moving the drill string in the well to position the downhole tool at the testing station. The method also includes measuring the formation pressure at the testing station (block 324). The formation pressure can be measured in any suitable manner, such as through use of the pretest chamber 114 and pump 116 to draw fluid from the formation as described above. Formation fluid can then be routed through the tool (block 326) from the formation and out to the wellbore. The method further includes expelling fluid from the pretest chamber (block 328), noting that the fluid expelled from the pretest chamber can be drawn through the tool by the pump 140 while the pump 140 routes formation fluid through the tool, as discussed above. The formation pressure can then be measured again (block 330) at the testing station (e.g., with the pretest chamber 114 and pump 116). Although the pretest chamber 114 and pump 116 can be used to measure the formation pressures at blocks 324 and 330, in other embodiments the pump 140 could instead be used. To reduce measurement error, the same pump (whether pump 116, 140, or some other pump) can be used to measure formation pressure at a given testing station before and after formation fluid is routed through the tool during a cleanup phase.

As previously noted, the additional formation pressure measurement taken at block 330 may be more accurate than the initial formation pressure measurement. This additional formation pressure measurement can be used to calibrate a formation pressure gradient (block 332) derived from other formation pressure measurements collected at multiple testing stations by the tool. In at least some instances, this calibration can be performed in real-time by the downhole tool while within the well. Also, the adjusted formation pressure gradient can be used to characterize a formation, which may include identifying a fluid boundary (e.g., a water-oil boundary) in the formation (block 334).

Figure 10:
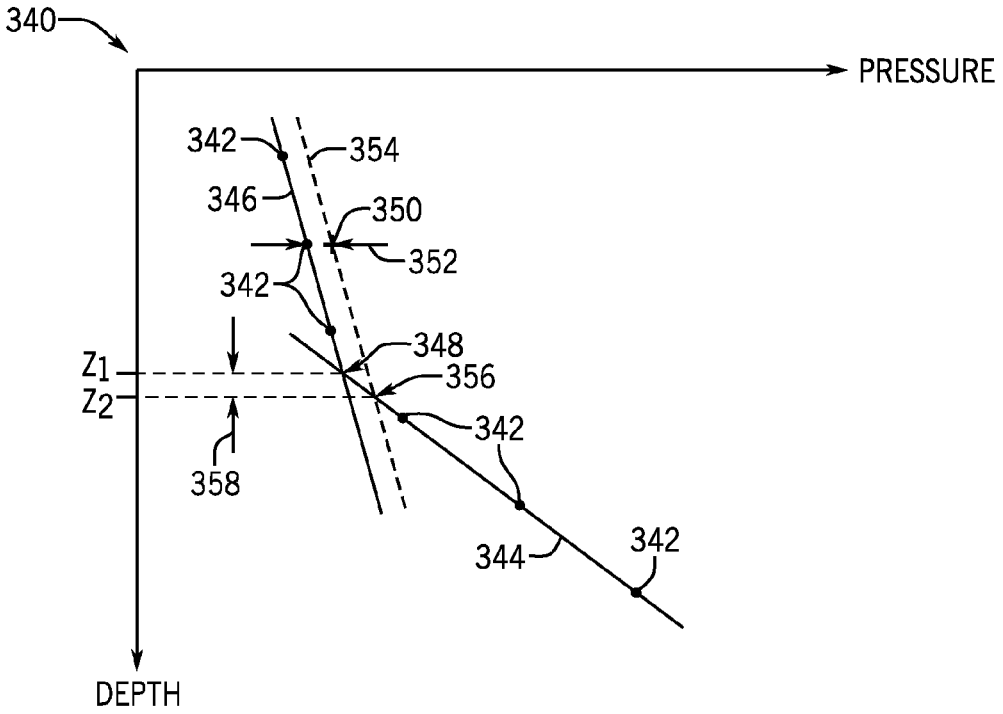
FIGS. 10 and 11 graphically depict calibration of formation pressure gradients in accordance with certain embodiments.
Figure 11:
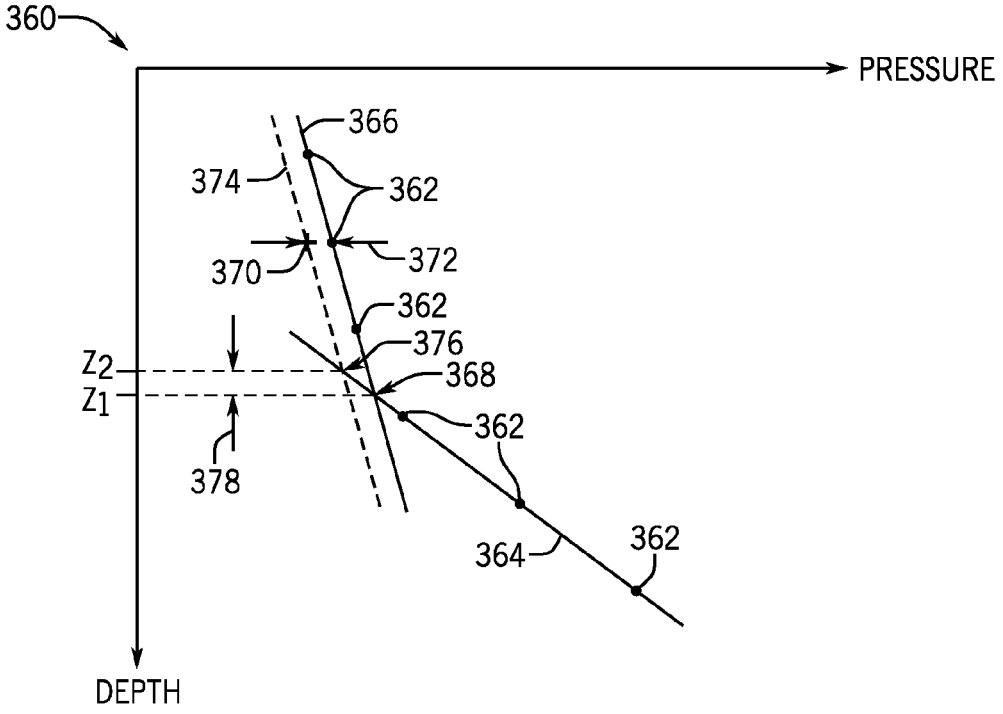

Examples of calibrating a formation pressure gradient with the additional measurement of formation pressure at a testing station after having routed fluid through the tool in a cleanup phase are graphically depicted in FIGS. 10 and 11. In the example of FIG. 10, data points 342 represent initial formation pressures that can be measured at testing stations at different depths in the well before cleanup phases at the stations. In this figure, the data points 342 are for a water-wet formation with an invaded zone of water-based mud. Although a small handful of data points 342 are presently depicted for the sake of clarity, it will be appreciated that formation pressure data can be collected at any desired number of testing stations to facilitate characterization of a tested formation. The change in formation pressure as a function of depth also depends on the type of fluid present in the reservoir at the tested depth. For instance, pressure may increase at a greater rate per unit depth in an area of the formation containing water and at a lesser rate per unit depth in an area containing oil. This is generally shown in FIG. 10 by a formation pressure gradient 344 corresponding to a water zone in the formation and a formation pressure gradient 346 corresponding to an oil zone in the formation.

The depicted gradients 344 and 346 intersect at point 348. Based on this intersection point 348, the free water level of the formation can be estimated to occur at depth $Z_1$ in the well. It will be appreciated that further testing and production activities may be conducted based on the estimated free water level, and efficiency of these activities can depend on an accurate estimation. As noted above, capillary pressure effects can introduce error in the formation pressure measurements. Particularly, in the present case of a water-wet formation and water-based drilling mud in an invaded zone, the data points 342 of initially measured formation pressures in the oil zone of the formation (that is, the data points 342 of the pressure gradient 346) can include an error resulting from capillary pressure between the water-based drilling mud and the oil in the formation. The additional formation pressure measurement taken after having routed formation fluid through the tool at a particular station (here depicted as data point 350) can exhibit less error, and can be used to horizontally calibrate the formation pressure gradient 346 for the oil zone of the formation (e.g., by shifting the oil zone gradient to the right in FIG. 10 by an error amount 352 equal to the different between the data point 350 and the data point 342 initially measured at the same testing station). The adjusted pressure gradient 354 for the oil zone intersects the pressure gradient 344 for the water zone at point 356, from which the free water level can be more accurately estimated, with the revised estimate adjusted downward by an amount 358 to depth $Z_2$.

FIG. 11 is similar to FIG. 10, but instead depicts data measured for an oil-wet formation with an invaded zone of water-based drilling mud. In this example, the data points 362 of initial formation pressure measurements taken at various depths can be used to determine formation pressure gradient 364 for a water zone and formation pressure gradient 366 for an oil zone. The intersect point 368 can be used to estimate the free water level as occurring at depth $Z_1$. An additional data point 370 of a formation pressure measured at a testing station after a cleanup phase (in which formation fluid is pumped through the tool to reduce the amount of drilling mud from the invaded zone present in the formation fluid drawn into the tool). Because this additional formation pressure measurement exhibits less error attributable to capillary pressure, the pressure gradient 366 for the oil zone may be calibrated based on the data point 370 (e.g., by shifting the oil zone gradient to the left in FIG. 11 by an error amount 372). The adjusted pressure gradient 374 for the oil zone can then be used to change the estimated free water level by an amount 378 based on the revised intersect point 376 between the pressure gradient 364 for the water zone and the adjusted pressure gradient 374 for the oil zone. While the examples of FIGS. 10 and 11 generally demonstrate adjustment for capillary pressure effects between water-based drilling mud and oil within a formation, it is noted that similar adjustments can be made in other embodiments for capillary pressure effects between oil-based drilling mud and water within a formation. Additionally, although various formation pressure gradients can be calibrated on the basis of an additional formation pressure measurement obtained at a single testing station after a cleanup phase, such additional, post-cleanup measurements can be collected at multiple testing stations and used to calibrate formation pressure gradients in other embodiments.

Figure 12:
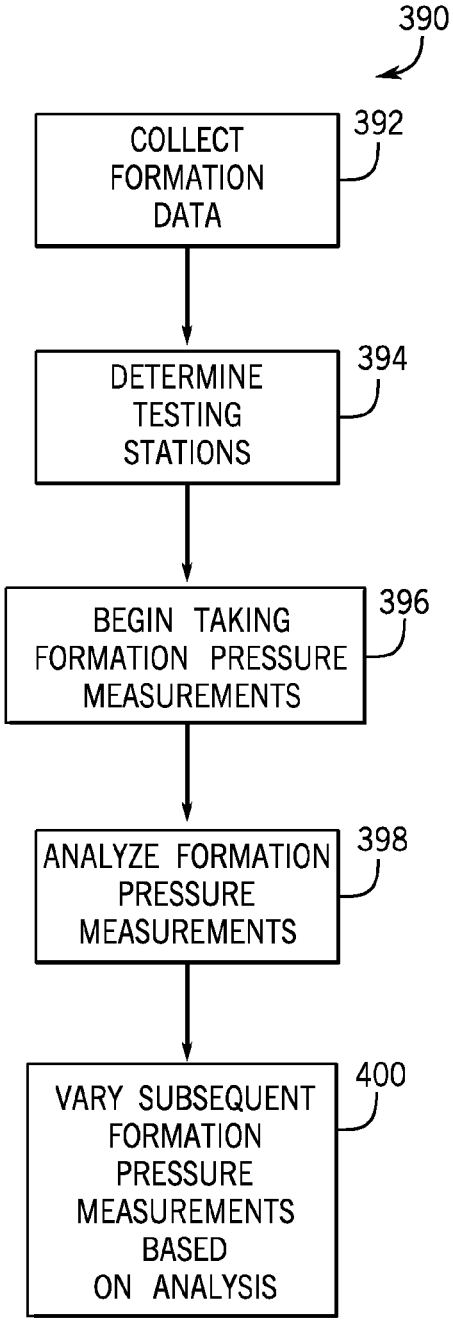
FIG. 12 is a flow chart representing an adaptive method for collecting formation pressure data in accordance with one embodiment.

In another embodiment generally represented in FIG. 12 by flow chart 390, a method includes collecting formation data (block 392) from a well and determining an initial set of testing stations (block 394) at which to take formation pressure measurements. For example, open-hole logs can be generated from data collected by a downhole tool during a logging run as it is lowered to the bottom of a well, and testing stations can be selected based on points of interest (locations or reservoirs, possible fluid boundaries, etc.) identified from the open-hole logs. As represented by block 396, the method includes beginning to take formation pressure measurements at the testing stations. In this embodiment, the formation pressure measurements collected at block 396 can be analyzed at block 398 and subsequent formation pressure measurements can be varied (block 400) based on the analysis. Particularly, in some embodiments, including that represented in FIG. 12, the collection of formation pressure measurements can be an adaptive process in which data collected during a formation pressure testing sequence can be used in real-time to vary the performance of a subsequent pressure test within the well. Such variation can include skipping testing stations initially selected for measurement, identifying new testing stations in addition to the initial set of testing stations, deciding while at a testing station to obtain an additional formation pressure measurement at that testing station (e.g., after a cleanup phase), or deciding to return the tool to a previous testing station to collect an additional formation pressure measurement or other data. Additionally, the process can include estimating the position of a fluid boundary within the formation from initial formation pressure measurements collected at a set of testing stations and then selecting one or more of those testing stations for additional formation pressure testing.

From the above description, it will be appreciated that the present disclosure introduces a method including: moving a drill string within a well to position a downhole tool of the drill string at a plurality of testing stations within the well; measuring formation pressures at the plurality of testing stations with the downhole tool; after measuring formation pressure at a testing station of the plurality of testing stations, routing formation fluid through the downhole tool while the downhole tool remains positioned at the testing station; measuring formation pressure again at the testing station with the downhole tool after routing formation fluid through the downhole tool and before moving the downhole tool away from the testing station; and using the formation pressure at the testing station measured after routing formation fluid through the downhole tool to calibrate a formation pressure gradient relating the formation pressures measured at the plurality of testing stations to well depth. In one embodiment, using the formation pressure at the testing station measured after routing formation fluid through the downhole tool to calibrate a formation pressure gradient relating the formation pressures measured at the plurality of testing stations to well depth may be performed by the downhole tool while within the well. The method may also include routing formation fluid through the downhole tool at multiple testing stations of the plurality of testing stations after measuring formation pressures at the multiple testing stations, measuring formation pressures again at the multiple testing stations with the downhole tool after routing formation fluid through the downhole tool at the multiple testing stations, and using the formation pressures at the multiple testing stations measured after routing formation fluid through the downhole tool to calibrate the formation pressure gradient.

Additionally, the method may include using a pretest chamber of the downhole tool to facilitate measurement of formation pressures at the plurality of testing stations and to facilitate measurement of formation pressure at the testing station of the plurality of testing stations after routing formation fluid through the downhole tool. In such an embodiment, using the pretest chamber can also include drawing formation fluid into the pretest chamber while the downhole tool is positioned at the testing station of the plurality of testing stations, expelling the drawn formation fluid from the pretest chamber while routing formation fluid through the downhole tool while the downhole tool remains positioned at the testing station, and again drawing formation fluid into the pretest chamber before moving the downhole tool away from the testing station. Further, the method can include sampling formation fluid at the testing station of the plurality of testing stations with the downhole tool or scanning formation fluid routed through the downhole tool.

It will be further appreciated that the present disclosure also introduces a method that includes lowering a downhole tool into a well and performing pressure tests at multiple depths within the well with the downhole tool to measure formation pressures at the multiple depths in an adaptive manner in which one or more measured formation pressures are used as input to vary performance of at least one subsequent pressure test within the well. In at least some instances, the one or more measured formation pressures can be used to select a desired depth within the well for the at least one subsequent pressure test. The method may also include collecting formation data with the downhole tool as it is lowered into the well and determining, based on the collected formation data, a set of testing stations at different locations within the well at which to perform the pressure tests. In at least one embodiment, performing the pressure tests at multiple depths includes taking first formation pressure measurements with the downhole tool at some or all of the testing stations, analyzing the first formation pressure measurements to identify one or more of the testing stations at which to take second formation pressure measurements, and taking the second formation pressure measurements with the downhole tool at the identified one or more testing stations. In such an embodiment, analyzing the first formation pressure measurements to identify the one or more testing stations at which to take the second formation pressure measurements may include estimating the position of a fluid boundary within a formation based on the first formation pressure measurements and selecting, based on the estimated position of the fluid boundary, the one or more testing stations at which to take the second formation pressure measurements.

The method can further include measuring the formation pressures at one or more testing stations of the set of testing stations and varying the set of testing stations based on the formation pressures measured at the one or more testing stations. Also, the method can include analyzing a formation pressure at a particular well depth and deciding, based on the analysis, to take an additional measurement of the formation pressure at the particular well depth. Still further, the method can include taking the additional measurement of the formation pressure at the particular well depth after a cleanup phase of routing formation fluid through the downhole tool. Finally, the method may also include moving the downhole tool in a first direction within the well to advance the downhole tool to multiple testing stations in the well, reversing the direction of movement of the downhole tool within the well based on the one or more measured formation pressures to return the downhole tool to a location in the well previously passed by the downhole tool, and measuring formation pressure at the location in the well.

The foregoing outlines features of several embodiments so that those skilled in the art may better understand aspects of the present disclosure. Those skilled in the art should appreciate that they may readily use the present disclosure as a basis for designing or modifying other processes and structures for carrying out the same purposes or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method comprising:

while a downhole tool remains positioned at a location within a wellbore:

drawing formation fluid from a formation into a pressure test chamber of the downhole tool;

measuring pressure of the formation fluid drawn into the pressure test chamber;

operating a first pump to route additional formation fluid from the formation through the downhole tool and out into the wellbore, wherein the additional formation fluid flows through the first pump; and operating a second pump to expel the formation fluid from the pressure test chamber and to mix the formation fluid with the additional formation fluid such that the formation fluid expelled from the pressure test chamber is also routed through the downhole tool and out into the wellbore along with the additional formation fluid.

2. The method of claim 1, comprising:

monitoring pressure within a flowline of the downhole tool through which the additional formation fluid is routed; and coordinating control of the first pump and the second pump so as to regulate the expelling of the formation fluid from the pressure test chamber, wherein coordinating control of the first pump and the second pump includes increasing a pumping rate of the first pump to draw the formation fluid expelled from the pressure test chamber through the flowline and out into the wellbore.

3. The method of claim 2, wherein coordinating control of the first pump and the second pump includes:

recognizing movement of a piston of the second pump to expel the formation fluid from the pressure test chamber into the flowline; and adjusting the pumping rate of the first pump to maintain a desired pressure within the flowline.

4. The method of claim 2, wherein coordinating control of the first pump and the second pump includes expelling the formation fluid from the pressure test chamber at a set rate with the second pump and increasing the pumping rate of the first pump by an amount equal to the set rate.

5. The method of claim 2, wherein operating the first pump includes operating a reciprocating piston within the first pump to route the additional formation fluid through the flowline, and wherein coordinating control of the first pump and the second pump includes:

detecting a change in direction of movement of the reciprocating piston within the first pump; and timing operation of the second pump to occur during movement of the reciprocating piston within the first pump after the detected change in direction of movement and before the reciprocating piston again changes direction.

6. The method of claim 1, comprising collecting a sample of the additional formation fluid with the downhole tool.

7. The method of claim 1, comprising, while the downhole tool remains positioned at the location, again drawing formation fluid from the formation into the pressure test chamber and measuring pressure of this formation fluid after operating the second pump to expel the previously drawn formation fluid from the pressure test chamber.

8. The method of claim 7, comprising:

positioning the downhole tool at additional locations within the wellbore;

measuring pressure of formation fluids drawn into the downhole tool at the additional locations; and determining a formation pressure gradient from the formation fluid pressures measured at the location and at the additional locations.

9. The method of claim 8, wherein determining the formation pressure gradient includes:

deriving the formation pressure gradient from the formation fluid pressures measured at the additional locations and the formation fluid pressure measured at the location before operating the second pump to expel the formation fluid from the pressure test chamber; and calibrating the formation pressure gradient with the formation fluid pressure measured at the location after operating the second pump to expel the previously drawn formation fluid from the pressure test chamber.

10. The method of claim 9, comprising identifying a fluid boundary within the formation based on the calibrated formation pressure gradient.

11. The method of claim 8, comprising, during a logging run with the downhole tool, selecting one or more of the additional locations for subsequent formation fluid pressure measurements based on previous formation fluid pressures measured by the downhole tool during the logging run.

* * * * *